United States Patent [19]

Woodard et al.

[11] 4,438,320

[45] Mar. 20, 1984

[54] THERMAL PRINTING APPARATUS HAVING A THERMAL PRINTHEAD SUBSTRATE WITH SPECIAL GEOMETRY FOR BI-DIRECTIONAL PRINTING

[75] Inventors: Thomas R. Woodard, Austin; Kenneth L. Martin, Houston, both of Tex.

[73] Assignee: Texas Instruments Incorporated, Dallas, Tex.

[21] Appl. No.: 82,443

[22] Filed: Oct. 9, 1979

[51] Int. Cl.[3] ..... H05B 1/00

[52] U.S. Cl. ..... 219/216; 346/76 PH; 355/3 FU; 400/120

[58] Field of Search ..... 219/201, 216, 385, 388, 219/543; 355/3 R, 3 FU; 346/76 R, 76 PH; 400/120, 124; 357/56

[56] References Cited

U.S. PATENT DOCUMENTS

| | | | |
|---|---|---|---|
| 3,596,055 | 7/1971 | Elston | 219/216 |
| 3,601,669 | 8/1971 | Merryman et al. | 219/216 X |
| 3,632,969 | 1/1972 | Walkow | 219/216 |
| 3,632,970 | 1/1972 | Walkow et al. | 219/216 |
| 3,855,448 | 12/1974 | Hanagata et al. | 219/216 |
| 3,973,106 | 8/1976 | Ura | 219/216 |
| 3,982,093 | 9/1976 | Henrion | 219/216 |
| 3,989,131 | 11/1976 | Knirsch et al. | 219/216 X |
| 4,110,598 | 8/1978 | Small | 219/216 |
| 4,151,397 | 8/1979 | Boor, Jr. et al. | 219/216 |

*Primary Examiner*—Volodymyr Y. Mayewsky
*Attorney, Agent, or Firm*—Melvin Sharp; N. Rhys Merrett; Thomas G. Devine

[57] ABSTRACT

A printhead configured to thermally print on thermally sensitive paper when traveling in either a forward or reverse direction across the paper. The substrate on which the thermal printhead is supported is especially configured to minimize drag between the printhead structure and the paper while traveling in either direction. As a result the travel dynamics of the printhead and the voltages required to insure uniform printing by the printhead are substantially independent of whether the printhead is traveling in a forward or reverse direction relative to the paper. The printhead may be mounted directly on a metallic substrate to increase heat dissipation and permit high speed printing.

2 Claims, 9 Drawing Figures

THERMAL PRINTING APPARATUS HAVING A THERMAL PRINTHEAD SUBSTRATE WITH SPECIAL GEOMETRY FOR BI-DIRECTIONAL PRINTING

This invention relates to thermal printheads and in particular to a printhead especially configured for high speed printing and for printing when traveling in either of two directions relative to thermally sensitive paper.

One type of thermal printhead is disclosed and claimed in U.S. Pat. No. 3,601,669 to Merryman et al and in U.S. Pat. No. 3,982,093 to Henrion. The printing element of such thermal printheads comprises a semiconductor wafer, a generally rectangular area of which is subdivided into a plurality of thermally and electrically isolated islands or "mesas" of semiconductor material. In a typical printhead there are five columns each containing seven such mesas. Thermally sensitive paper supported by a rotatable platen is located in contact with the portion of the semiconductor wafer containing the mesas. Each of the mesas contains, in integrated circuit form, a heater transistor, which, when turned on by an external logic signal, serves to generate a hot-spot at the surface of the mesa. The external logic signal permit selective control over the generation of hot-spots in the various mesas. By proper selection of the mesas to be energized, an alphanumeric or other character may be printed on the thermally sensitive paper. Other thermal printheads may be fabricated using thick film or thin film techniques and may utilize resistive heating rather than transistor heating in the individual elements of a matrix.

In either case such a thermal printhead may typically have dimensions of approximately one hundred mils by one hundred and fifty mils and be approximately three mils in thickness. The small printhead is typically supported on a ceramic substrate material which may have dimensions of the order of one inch by one half inch with a thickness of about ten mils. Electrical connections to the printhead may be made by conductors located on the substrate and the entire structure may be further mounted on an aluminum heat sink. The entire structure is translated by a carriage mechanism and thereby positioned relative to the thermal paper for printing purposes.

The tops of the mesas which contact the thermally sensitive paper are substantially coplanar with a plane which is parallel to the surface of the substrate material. Since the thermally sensitive paper is supported by a platen, it presents a rounded rather than a flat surface to the planar printhead matrix. In order to insure uniform heating by all the mesas of a printhead it is customary to exert sufficient pressure by the printhead against the paper and platen to slightly deform the resilient material of the platen. As a result, uniform contact occurs across the dimensions of the matrix and uniform printing results.

If the substrate were arranged to be parallel to the longitudinal axis of the platen, in view of the very small thickness of the printhead itself, the pressure exerted against the platen might cause the substrate as well as the printhead to contact the thermally sensitive paper. This would result in substantial drag as the printhead structure is stepped along the paper for the purpose of printing additional characters. Therefore, it has been the practice in some prior art thermal printers to mount the substrate at a slight angle relative to the axis of the platen, typically one degree off parallel. If the printhead itself is located at the end of the substrate closest to the platen, then only the printhead will be in contact with the paper. In this way the only friction force is that existing between the printhead and the paper. This is sufficiently low to permit translation of the printhead relative to the paper without lifting the printhead from the paper at each step.

With such an apparatus the small flat area formed between the surface of the printhead matrix and the paper has also been one degree from parallel with the axis of the platen. Moving the printhead along the platen without lifting causes a small wave to propagate in the soft platen material ahead of the actual contact area. As a result of the lack of parallelism between the printhead face and the longitudinal axis of the platen, the characteristics of the wave are different for forward or reverse motion of the printhead. If the printhead is used to print in one direction only, these differences are not material to its operation. Typically the printhead is lifted from the paper for carriage returns. If, however, it is desired to print while traveling in either direction, the different characteristics become material. The mechanism utilized to move the carriage relative to the platen must account for differences in the dynamics between forward and reverse directions of travel. Further, it happens that the nature of the contact between the printhead and the thermally sensitive paper differs as a function of direction of travel. Accordingly, the voltage utilized to generate heating in the elements of the thermal printhead matrix would have to be varied as a function of direction of travel. To accommodate such differences would result in substantial additional complexity in the mechanism of the printer.

As noted above, the ceramic substrate on which the printhead is mounted may further be mounted on a metallic heat sink. This provides for rapid dissipation of the residual heat in a mesa of the printhead after the mesa is turned off. In the absence of such heat sinking, repeated energization of a printhead could cause it to develop a background temperature that increases to a point where printing occurs on the thermally sensitive paper irrespective of the state of electrical energization of the individual mesas.

Such heat sinking has proven effective in certain printers. We have discovered, however, that if one attempts to increase the print speed beyond a certain point, that is beyond a given number of characters per second, spurious printing is experienced with such structures.

Accordingly, it is an object of the invention to provide a thermal printer mechanism wherein the travel dynamics of the printhead relative to the thermally sensitive paper and platen on which the paper is located are independent of the direction of travel.

It is another object of the invention to provide a thermal printer mechanism wherein the voltages required to heat the elements of the thermal printhead are substantially independent of the direction of travel of the printhead relative to the thermally sensitive paper.

It is yet a further object of the invention to provide a thermal printer structure having an increased print speed.

Briefly these and other objects of the invention are achieved by a printhead structure wherein the planar surface of the printhead matrix is substantially parallel to the longitudinal axis of the platen. The substrate on which the printhead is mounted is specially configured so as not to contact the paper despite pressure forcing the printhead itself to slightly deform the underlying platen. In this way frictional forces between the printhead structure and the paper are kept low while the travel and printing dynamics of the printhead are independent of the direction of travel.

It is believed that a limitation on print speed is the result of the relatively low thermal conductivity of the ceramic substrate. This provides a barrier to the conduction of heat from the printhead to the metallic heat sink. Accordingly, in one embodiment of the invention, the thermal printhead is affixed directly to the metallic heat sink.

These and other objects and features of the invention may be better understood by a consideration of the following detailed description together with accompanying drawings wherein:

FIG. 9 shows a partial side view of the substrate, printhead and platen.

Figure 1:
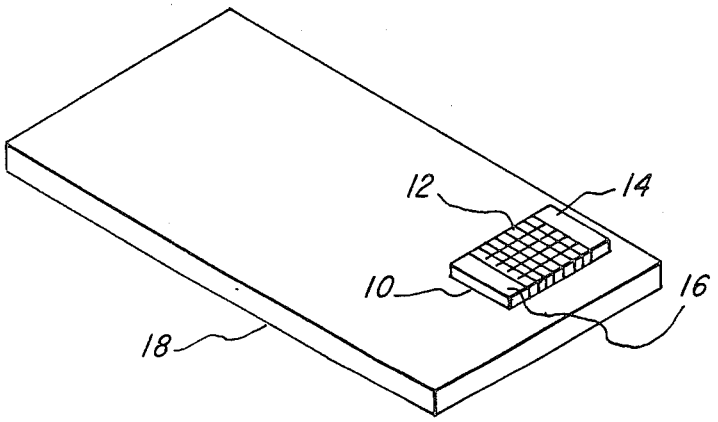
Fig. 1 (PRIOR ART)
FIG. 1 is a perspective view of a prior art thermal printhead and substrate.

FIG. 1 illustrates a typical prior art thermal printhead structure. A semiconductor wafer 10 is subdivided into a plurality of thermally and electrically isolated islands or mesas of semiconductor material 12. The mesas, which typically comprise a five by seven matrix, are selectively heated and, as such, when in contact with the thermally sensitive paper produce a visual pattern on the paper. Wafer 10 is adhesively bonded to a supporting substrate material 18 which may typically be a ceramic. While not shown, substrate 18 may further be located upon a metallic heat sink and the entire structure transported by a carriage mechanism relative to the thermally sensitive paper. Electrical connections to the structure may be by means of electrical conductors located on the bottom surface of substrate 18. Electrical contact between these conductors and wafer 10 is established through openings in the substrate located generally below areas 14 and 16 of wafer 10.

Figure 2:
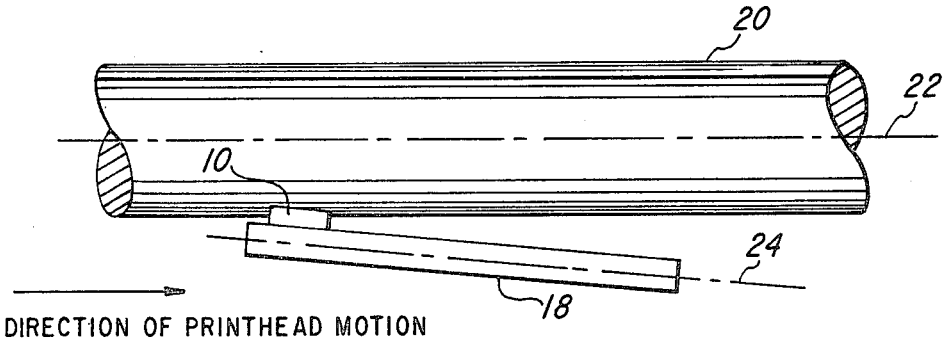
Fig. 2 (PRIOR ART)
FIG. 2 shows the orientation of a prior art printhead relative to its platen.

FIG. 2 illustrates how the thermal printhead structure is oriented relative to a platen 20 in a typical prior art printing arrangement. The view is looking down on platen 20 and provides an edge view of substrate 18 and wafer 10. While not shown expressly, thermally sensitive paper would be located on platen 20 and under the thermal printhead. Sufficient pressure is exerted upon the printhead structure to cause it to slightly deform the resilient material of platen 20 thereby insuring intimate contact between the entire surface of the five by seven matrix of mesas and the underlying thermally sensitive paper. To eliminate the chance that portions of substrate 18 might inadvertently contact the thermally sensitive paper and underlying platen, and thereby introduce unacceptable drag, axis 24 of substrate 18 is arranged to be nonparallel to axis 22 of platen 20. The departure from parallelism is typically of the order of one degree.

The direction of printhead motion when printing relative to platen 20 is from left to right in FIG. 2. As the printhead is moved along platen 20 without lifting a small wave is caused to propagate in the resilient platen material ahead of the actual printhead contact area. It may readily be perceived that the characteristics of the wave are different for forward and reverse motion of the printhead. This is not a problem in printers where printing occurs only during forward motion of the printhead. In such printers the printhead is lifted off of the paper for carriage returns. In a bidirectional printer, however, the geometry of FIG. 2 would necessitate complex carriage drive electronics to account for the differences in mechanical dynamics between the forward and reverse direction of travel.

Further, the propagating wave induced by the movement of the printhead relative to platen 20 affects the intimacy of the contact between the printhead and the thermally sensitive paper. This effect also differs as a function of whether the printhead is moving in the forward or reverse direction. Consequently, the geometry of FIG. 2 would require electronics to provide two different voltages to the mesas of the printhead corresponding to the two possible directions of motion.

Figure 3:
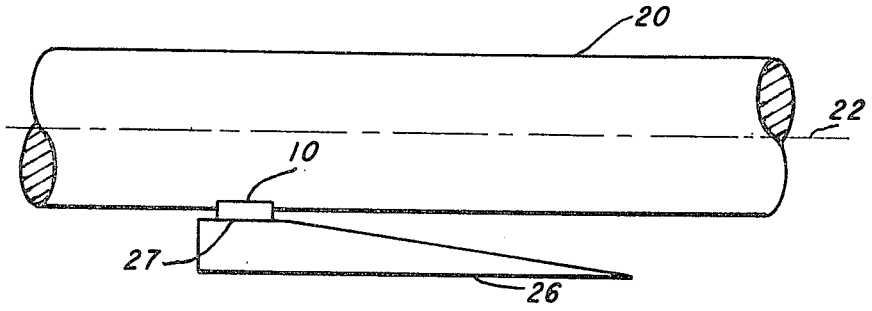
FIG. 3 illustrates a lapped ceramic embodiment of the invention.
Figure 4:
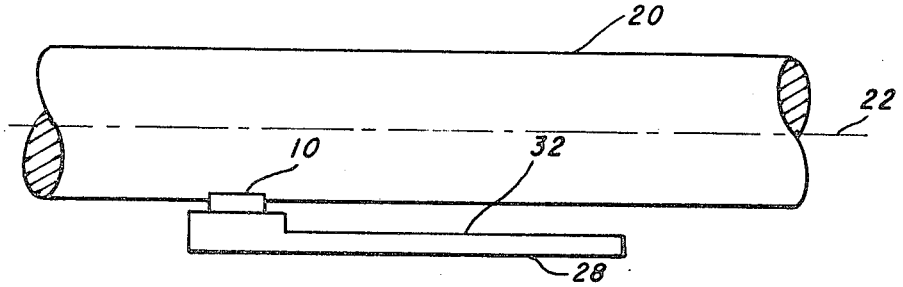
FIG. 4 illustrates a stepped ceramic embodiment of the invention.
Figure 5:
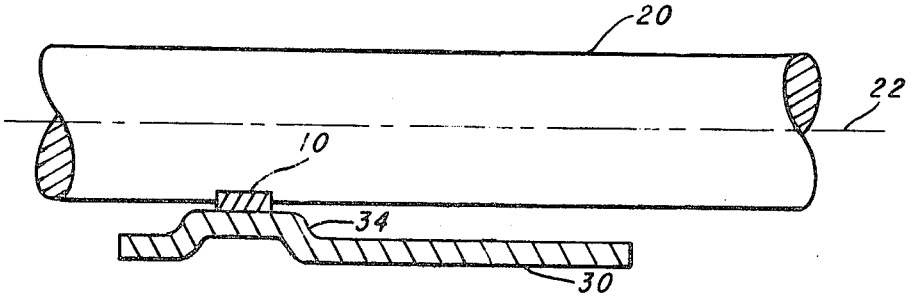
FIG. 5 illustrates an embodiment utilizing a stamped substrate.

These deficiencies of prior art structures for use in a bidirectional thermal printer are overcome by the various embodiments of the invention as illustrated in FIGS. 3, 4 and 5. In each of these FIGURES thermal printhead 10 is supported to bear upon the thermally sensitive paper (not shown) and platen 20 with sufficient force to cause a flat spot in the resilient material of platen 20 of an area substantially equal to that of the face of thermal printhead 10. Moreover, in each of these embodiments of the invention, thermal printhead 10 is supported so that its planar face is substantially parallel to longitudinal axis 22 of the platen. As a result of this parallel relationship, the motion dynamics of thermal printhead 10 relative to the thermally sensitive paper and platen 20 may be expected to be the same irrespective of whether the thermal printhead is moving to the right or to the left relative to the paper and platen. In particular the waves induced in the material of platen 20 by motion of thermal printhead 10 will be substantially of the same nature irrespective of the direction of travel of the printhead. Similarly, the intimacy of contact between the planar face of printhead 10 and the thermally sensitive paper will be substantially the same irrespective of the direction of travel.

In each of FIGS. 3, 4 and 5 this desirable bidirectionality is achieved with a support configuration which insures that the support itself does not bear against the thermally sensitive paper and platen in a way that would cause undesirable frictional forces. In FIG. 3 support means 26 comprises a standard ceramic substrate which is lapped or ground at about a one degree angle. There is a small ledge in area 27 for supporting thermal printhead 10. In this way the printhead is maintained in a parallel relationship to the platen while those portions of supporting means 26 remote from the region of the printhead slope away from the platen so as to avoid contact therewith.

FIG. 4 illustrates a stepped ceramic embodiment of the invention. Substrate 28 comprises a conventional ceramic substrate with a normal thickness in the region underlying thermal printhead 10. The remainder of the substrate in region 32 is ground so as to provide suitable clearance between that portion of substrate 28 and platen 20. Again, in this way it is possible to apply sufficient force to ensure intimate contact between the thermal printhead and the underlying paper while avoiding contact between the majority of substrate 28 and the paper.

Figure 6:
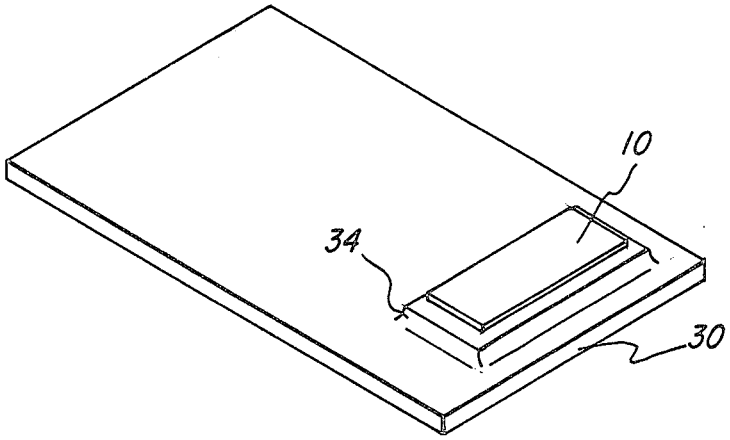
FIG. 6 is a perspective view of the stamped substrate embodiment.

FIGS. 5 and 6 illustrate another embodiment of the invention. Substrate 30, which is illustrated in sectional view in FIG. 5 and in perspective view in FIG. 6 may comprise either a conventional ceramic substrate or a metallic substrate. In either case an elevated portion is stamped into the substrate in the region 34 and thermal printhead 10 is mounted on this elevated portion. In the case of the ceramic substrate the elevated portion is stamped while the ceramic material is still in its green state prior to firing or curing.

Figure 8:
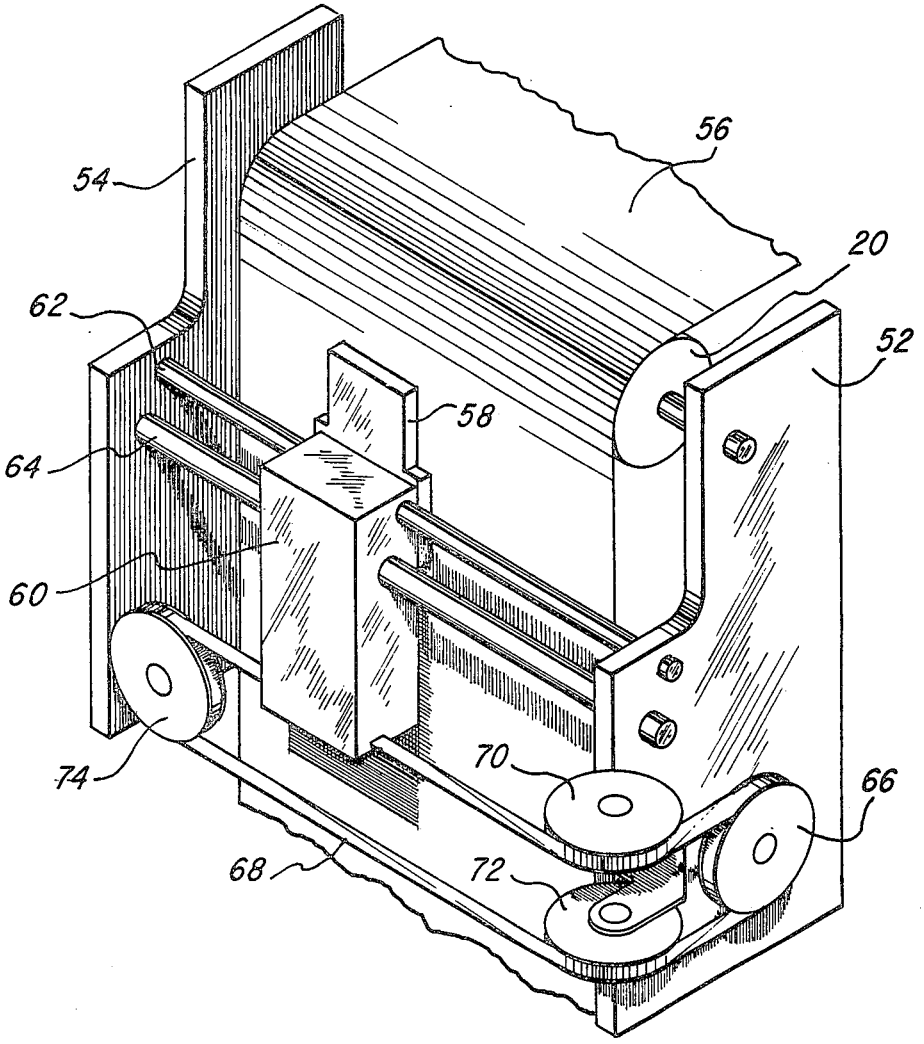
FIG. 8 shows a thermal printing apparatus embodying the invention.

In each of the various embodiments utilizing a ceramic substrate, electrical contact between thermal printhead 10 and its drive electronics are established in the conventional manner. The substrate and thermal printhead are transported by a carriage mechanism along the length of the platen as illustrated in FIG. 8. The drive electronics are located at a fixed position in the printer terminal or the like and electrical contact is established between the drive electronics and the substrate by means of a flexible member. The flexible member typically comprises a thin web of a material such as a polymer sold under the trade name of Kapton by duPont. A plurality of electrical conductors are formed on one surface of the web to run substantially longitudinally of the web. As is well known in the art such conductors may be formed by placing a conductive metallic layer on the web and then photolithographically etching away excess metal to leave the conductors. An additional Kapton web may be located over the conductors so as to form a sandwich structure. The conductors at one end of the web are in electrical contact with the drive electronics. The conductors at the other end of the web are in contact with a corresponding pattern of conductors formed on the back of ceramic substrates 26, 28 or 30. The conductors on the substrate, which may be formed using conventional deposition and etching steps, extend from the point of contact near the right end of the substrate in FIGS. 3–5 to the general vicinity of printhead 10. Contact there is established between the substrate conductors and corresponding contacts on printhead 10 by means of small wires extending through small openings in the substrate itself. The small wires are typically bonded to the substrate conductors and to the printhead contacts using well known stitch bonding techniques.

As mentioned previously, in accordance with the present invention, in the embodiment illustrated in FIGS. 5 and 6 substrate 30 may comprise the metallic heat sink itself. In this case printhead 10 is bonded directly to the heat sink so as to provide a high thermal conductivity path from the printhead. As a result heat energy is removed from the printhead and dissipated very efficiently by metallic substrate 30. Such a structure avoids the high temperature build up in printhead 10 that is encountered in very high speed printing with conventional thermal printhead structures.

Figure 7:
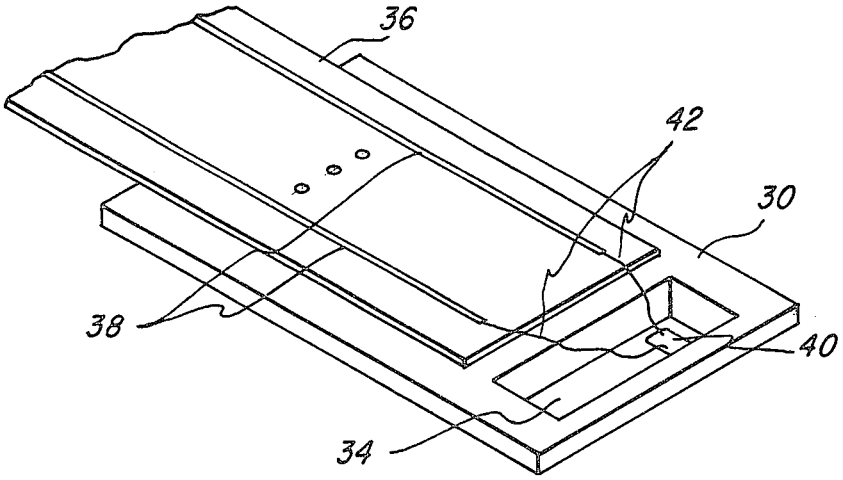
FIG. 7 illustrates one method of providing external connections when the substrate is metallic.

One means of providing external connections to this last illustrated embodiment of the invention is shown in FIG. 7 which provides a bottom view of the printhead structure. In this bottom view of metallic substrate 30 the elevated portion 34 appears as a recess. An opening 40 in elevated portion 34 provides access to contact pads on the bottom side of thermal printhead 10. A flexible web 36 such as that discussed above has a plurality of conductors 38 formed thereon (only two of the conductors are illustrated for convenience). In this case the web is bonded directly to metallic substrate 30 so that its conductors extend to the vicinity of the thermal printhead itself. Contact is established between the web conductors and the contact areas on thermal printhead 10 by means of small wires 42 which may be affixed utilizing conventional stitch bonding techniques. As mentioned previously, an additional Kapton web may be located over conductors 38 so as to provide a sandwich structure therefore. Recessed area and connecting wires 42 may be encapsulated in a suitable epoxy potting material so as to provide a rigid mechanical structure.

As an alternative to bonding web 36 to metallic substrate 30, the bottom of the substrate may be coated with a suitable insulating material such as porcelain. Then a suitable conductor pattern may be formed on the porcelain utilizing techniques similar to those described above for forming conductors on the ceramic substrates. In this case electrical connections are established from the drive electronics through the web conductors, through the substrate conductors, and ultimately to the thermal printhead in the same way as in the case of the ceramic substrate structures.

FIG. 8 illustrates an electronic thermal printing apparatus embodying the present invention. Two endplates 52 and 54 provide the support for feeding the thermally sensitive paper 56 on platen 20 so that it faces the thermal printhead which is located on the back of heat sink 58. Heat sink 58 is mounted on a carriage 60 which in turn is slidably mounted on supports 62 and 64. Lateral movement of carriage 60 is effected by a stepper motor (not shown) which is located on the interior of bracket 52. The stepper motor provides the drive for drum 66 around which is wound a plurality of turns of a cable 68. Cable 68 as it leaves drum 66 is wound around pulley 70 and is connected to one side of carriage 60. The other end of cable 68 as it leaves drum 66 is wound around pulley 72, pulley 74 and connects to the other side of carriage 60. Rotation of the stepper motor is coupled by the cable system to the carriage to cause it to move in a selected direction lateral to the thermally sensitive paper 56. Printing apparatus employing a stepper motor for carriage control typically operates in a mode wherein the printhead is motionless relative to the paper during the printing operation. It is also within the contemplation of this invention to drive the carriage with a continuous drive motor and to perform the printing operation on-the-fly, that is while the printhead is moving relative to the paper.

FIG. 9 is a partial side view illustrating carriage 60 to which substrate 28 of FIG. 4 is attached. Thermal printhead 10 is shown attached to a stepped portion of substrate 28, contacting medium 56 which is moved by platen 20.

It is to be understood that the above described embodiment and methods are merely illustrative of the invention. Numerous other arrangements may be derived by those skilled in the art without departing from the spirit and scope of the invention as defined by the appended claims.

What is claimed is:

1. Thermal printing apparatus comprising:

(a) a cylindrical, rotatable platen for supporting a thermally sensitive medium, (b) a thermal printhead, movable from left to right and right to left with respect to the platen, with a substantially planar face adapted to contact portions of said thermally sensitive medium and to form visual markings thereon, and (c) a lapped ceramic substrate for supporting said thermal printhead in contact with said thermally sensitive medium with said planar face substantially parallel to the longitudinal axis of said platen said lapped ceramic substrate being configured to avoid contact with said thermally sensitive medium.

2. Thermal printing apparatus comprising:

(a) a cylindrical, rotatable platen for supporting a thermally sensitive medium, (b) a thermal printhead, movable from left to right and right to left with respect to the platen, with a substantially planar face adapted to contact portions of said thermally sensitive medium and to form visual markings thereon, and (c) a stepped ceramic substrate for supporting said thermal printhead in contact with said thermally sensitive medium with said planar face substantially parallel to the longitudinal axis of said platen, said stepped ceramic substrate being configured to avoid contact with said thermally sensitive medium.

* * * * *